United States Patent [19]

Cunningham

[11] 4,070,850

[45] Jan. 31, 1978

[54] ASSEMBLY MACHINE FOR INTERCONNECTED CARRIER DEVICES

[75] Inventor: Ernest Ray Cunningham, Libertyville, Ill.

[73] Assignee: Grip-Pak, Inc., St. Louis, Mo.

[21] Appl. No.: 771,565

[22] Filed: Feb. 24, 1977

[51] Int. Cl.[2] ..... B65B 13/02; B65B 17/02; B65B 27/04

[52] U.S. Cl. ..... 53/48; 53/196

[58] Field of Search ..... 53/3, 35, 48, 49, 196, 53/198 R, 198 B

[56] References Cited

U.S. PATENT DOCUMENTS

| | | | |
|---|---|---|---|
| 3,383,828 | 5/1968 | Cunningham | 53/48 |
| 3,447,280 | 6/1969 | Cunningham et al. | 53/48 |

*Primary Examiner*—Robert Louis Spruill
*Attorney, Agent, or Firm*—Michael Kovac

[57] ABSTRACT

An assembly machine for interconnected carrier devices is disclosed as including carrier assembly means that move in a closed triangular path and are arranged to assemble the interconnected carrier devices to containers moving in a linear path, beginning on one or another side or margin of said containers that is generally transverse to the movement thereof, depending on the direction of movement of said carrier assembly means in the closed path.

11 Claims, 6 Drawing Figures

ASSEMBLY MACHINE FOR INTERCONNECTED CARRIER DEVICES

SUMMARY OF THE INVENTION

Several different techniques have been employed for assembling an interconnected series of plastic carrier devices to containers. Historically, these have included the vertical assembly of carriers to non-moving containers such as disclosed in U.S. Pat. No. 2,929,181; the application of carriers to containers moving in a horizontal path by a rotary carrier application drum as disclosed in U.S. Pat. Nos. 3,032,943 and 3,032,944; the application of carriers to containers moving in a horizontal path by carrier applicating elements moving in an endless oblong path as disclosed in U.S. Pat. No. 3,383,828; and the application of carriers to containers moving in a horizontal path by cooperating pairs of carrier applicating mechanisms that are mounted for movement in closed paths, one being contained within the other, and both being operated at a predetermined faster speed than the containers moving in the horizontal path, as disclosed in U.S. Pat. No. 3,906,704. While there have been other designs, the above described are the principal ones.

It will be appreciated that vertical assembly techniques are limited since carriers cannot be continuously applied to containers without interruption. Application of carriers by rotary carrier applicating drums requires complex and costly mechanisms that operate with the limitation that carriers must be transferred within the space of approximately one can diameter since the rotary drum has a limited path of movement which coincides with the horizontal path of containers.

Therefore, carrier applicating elements moving in an endless path provide a substantial linear portion that coincides with the horizontal path of containers to allow carriers to be progressively applied to containers along the linear portion of the endless path. Assembly apparatus of this type not only provides an inherently speedier and more efficient transfer of carriers to containers, but the design principles that are employed simplify the machine elements and, therefore, the cost of construction and maintenance. Examples of such assembly machines are shown by aforementioned U.S. Pat. No. 3,383,828 where an endless oblong path is employed, and U.S. Pat. No. 3,906,704 where cooperating pairs of carrier applying elements operate in closed, irregular, yet elongated paths.

The present invention is directed to assembly apparatus of this last mentioned type where there is also included a particularly efficacious endless path having a substantial linear portion that is employed.

In addition, the present invention includes other assembly features which have heretofore been unobtainable. Some of the aforementioned assembly mechanisms can be used to apply only one type of carrier device, such as shown in now expired U.S. Pat. No. 2,874,835. This is clearly disadvantageous to the assembly machine user since other types of more economical carrier devices cannot be purchased. For example, scrapless carrier devices of the type shown in U.S. Pat. Nos. 3,785,484 and 3,966,044 cannot be applied with efficiency due to machine function, overstretching and other limitations of some of the aforementioned assembly apparatus.

A further disadvantage of some of the aforementioned assembly apparatus is that carriers can be applied to containers by stretching the openings in the carriers in only one way. With certain carrier designs, it may be advantageous to stretch the openings of the carriers in several ways, due to design of the carrier that is being used in the assembly apparatus.

Accordingly, it is an object of the present invention to provide a new continuous-in-line assembly apparatus for assembling an interconnected series of plastic carriers to containers moving in a predetermined linear path.

More specifically, it is the object of the present invention to provide an assembly apparatus which is simple and economical to manufacture and maintain; is highly efficient in operation; is capable of applying several different types of plastic carrier devices; and can be used to apply carriers to containers in several different ways.

These and other objects and advantages of the present invention are attained by the provision of conveyor means for moving containers along a predetermined linear path, and carrier assembly means arranged to move in a predetermined closed triangular path such that the carrier assembly means can assemble carriers to containers beginning either on one side or another of said containers that is generally transverse to the movement thereof, depending on the direction of movement of said carrier assembly means in said closed path.

DESCRIPTION OF THE PREFERRED EMBODIMENTS

Figure 1:
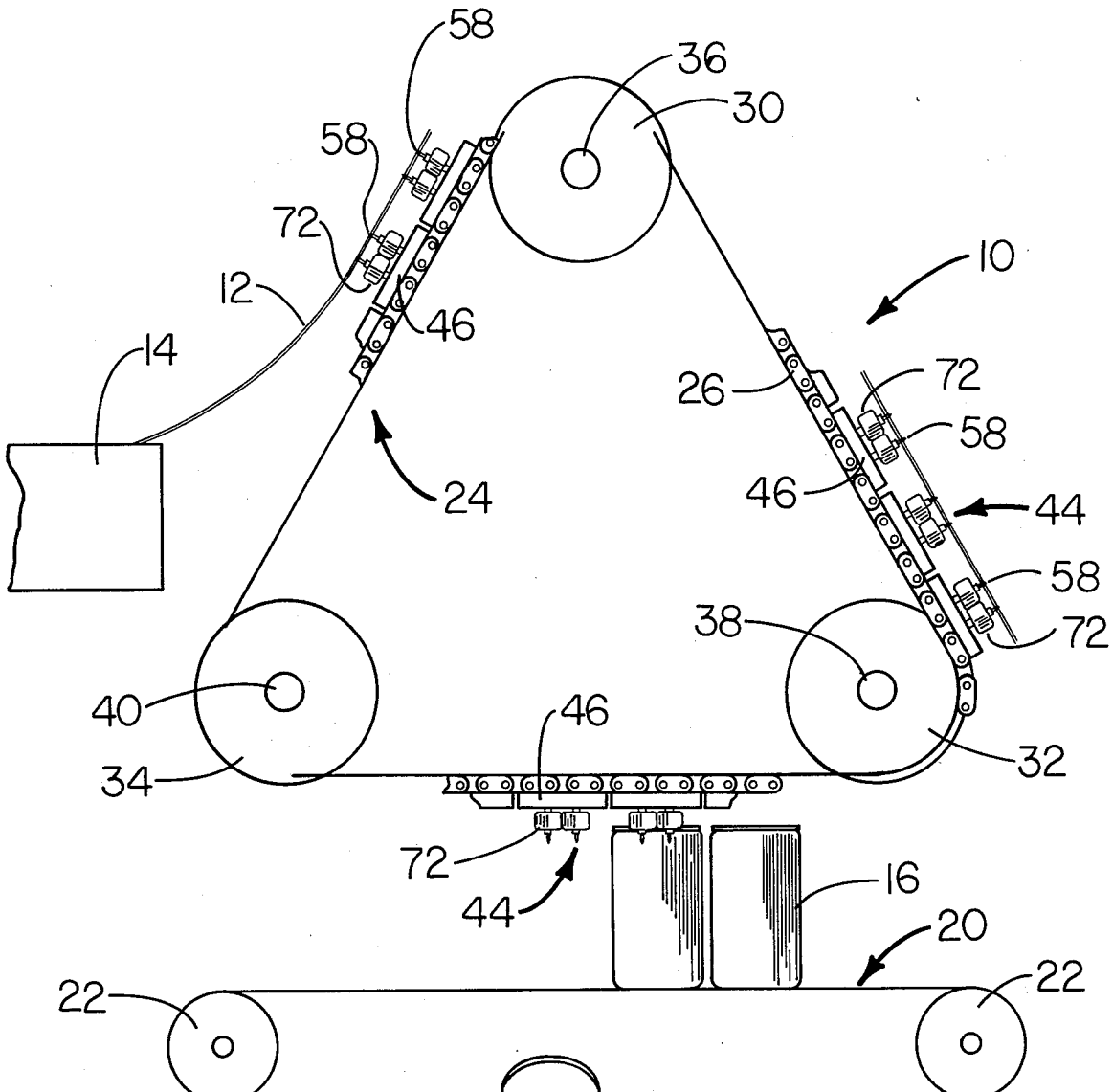
FIG. 1 is a fragmentary side elevational view of an assembly apparatus embodying the principles of the present invention.
Figure 2:
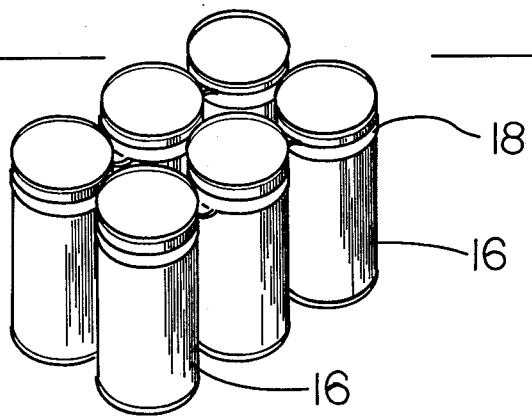
FIG. 2 is a perspective view of the type of container multi-package that is held together by a plastic carrier device assembled thereto by the assembly apparatus of the present invention.

The assembly apparatus 10 of the present invention, as shown in FIGS. 1 and 3 thru 5, is intended to apply an interconnected series or strip of plastic carrier devices 12 emanating from a storage container, 14, as shown at the left hand side of FIG. 1, to the upper ends of container 16 as shown in FIG. 2 of the drawings. An example of the resulting multi-package that is formed, as seen in FIG. 2, comprises the well known six-pack configuration including a plurality of containers 16 held together by a plastic multi-package device 18. The assembly apparatus 10 of the present invention is not limited to forming multi-packs with a predetermined number of containers; nor is the assembly apparatus 10 limited to particular types of plastic carrier devices or containers. Thus, the assembly apparatus 10 is adaptable to meet the varying demands of beverage and food producers who want to market their product in various container multiples and sizes, with the availability of more than one type of plastic carrier device.

In addition to manufacturing and shipping economics, the interconnected strip 12 of plastic carrier devices 18 permits adjacent carrier devices to feed one another during the assembly operation, as will be apparent in the ensuing discussion.

Figure 3:
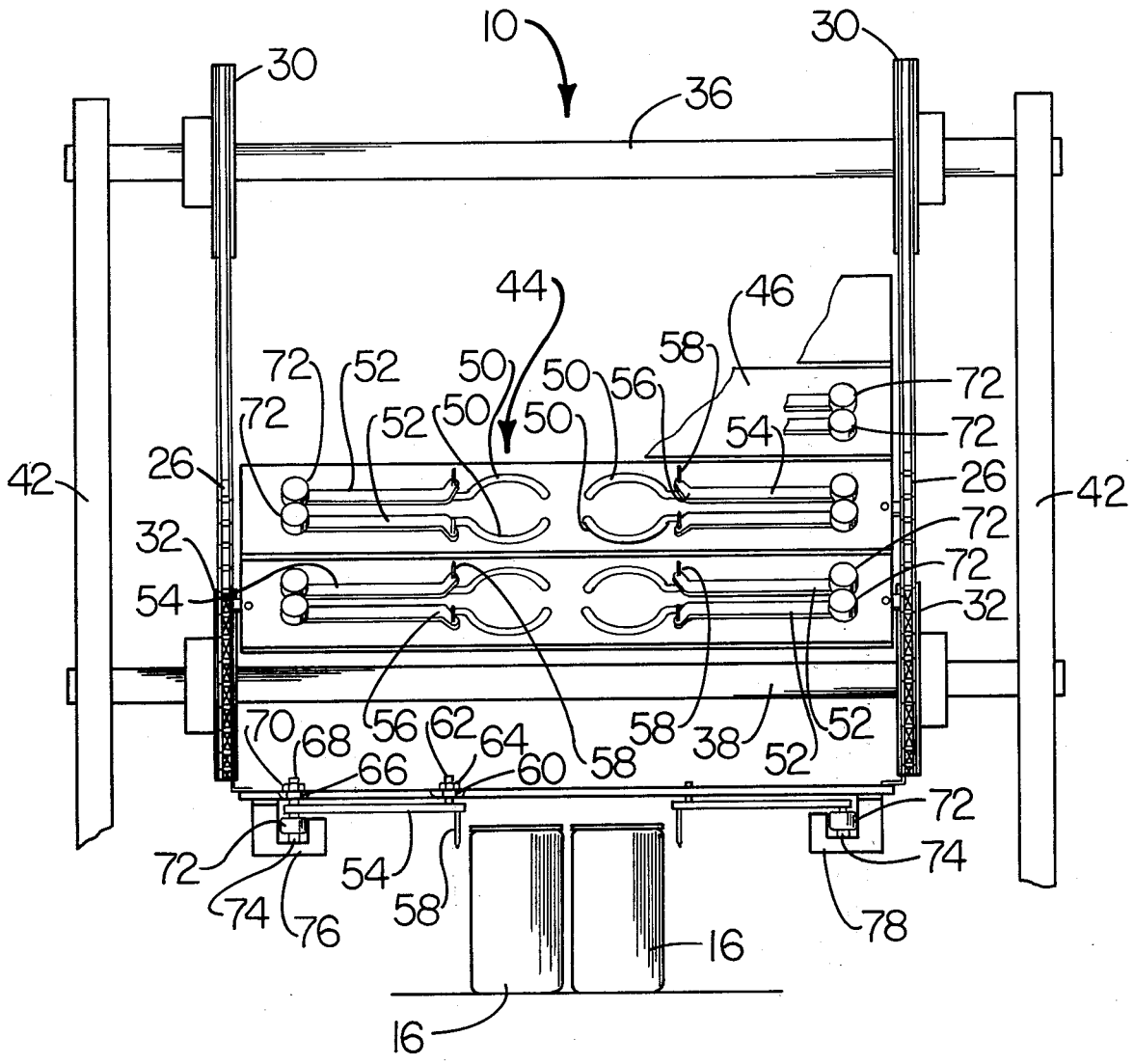
FIG. 3 is a fragmentary end elevational view of the assembly apparatus shown in FIG. 1.

For an overall view of the assembly apparatus 10 of the present invention, reference is made to FIGS. 1 and 3. There, it will be seen that the assembly apparatus 10 includes conveyor means 20 for moving a plurality of containers 16 in two juxtaposed rows along a generally linear or horizontal path. The conveyor means 20 is shown schematically as entrained about conveyor sprockets 22, at least one of which is driven by suitable drive mechanisms (not shown). Various types of conveyor means may be employed in the assembly apparatus 10.

The containers 16 are moved in double file procession through the assembly apparatus 10 in a manner such that the containers 16 are equidistantly spaced from one another in the linear or horizontal path of movement. Equidistant spacing can be achieved by various mechanisms, including the use of free-spinning rollers which engage the sides of containers 16, as shown, for example, in my U.S. Pat. No. 3,906,704.

The assembly apparatus 12 further includes carrier assembly means 24 that is arranged to move in a predetermined closed triangular path including a lower linear or horizontal portion that coincides with the linearly moving path of juxtaposed containers 16 at the upper end thereof. The carrier assembly means 24 include a pair of spaced chain elements 26, 26 which are each entrained about three pairs of spaced sprockets 30, 32 and 34 respectively to that are positioned in a triangular relationship to one another. Sprockets 30, 32 and 34 are mounted on shafts 36, 38 and 40 respectively which are themselves journalled in the frame supports 42. Suitable drive means (not shown) are employed to drive the spaced chain elements 26, 26 in synchronous and similar speed relationship to one another in either direction. Thus, the spaced chain elements 26, 26 are jointly power driven together, in either direction, through a generally triangular path that somewhat resembles an equilateral trinagle except for the rounded corner portions where the chain elements 26, 26 are entrained about the sprockets 30, 32, and 34.

The carrier assembly means 24 further includes a plurality carrier applicating mechanisms 44 that are attached to and driven by the spaced chain elements 26, 26 in the aforementioned triangular path. These carrier applicating mechanisms 44 are best seen in FIGS. 3–6 of the drawings, with an enlarged view in FIG. 4 and the operation of the carrier applicating mechanisms 44 throughout the triangular path being shown in FIGS. 5–6.

Each carrier applicating mechanism 44 includes carrier plate elements 46 attached to the spaced chain elements 26, 26 at opposite ends thereof and having configured slots 48, 48 and 50, 50 formed in each end in mirror image relationship to each other. Slots 48, 48 are generally transverse to triangular path of movement. Slots 50, 50 are partially parallel, but are mostly generally curvilinear to each other and correspond to the general cylindrical configuration of containers 16.

Each carrier applicating mechanism 44 further includes opposing pairs of cooperating pin elements 52, 52 which are mounted to each carrier plate element 46 in the slots 48, 48 and 50, 50 thereof. Thus, each carrier plate element 46 includes two pairs of cooperating pin elements 52, 52 which are slidably mounted in the slots 48, 48 and 50, 50 thereof.

Figure 4:
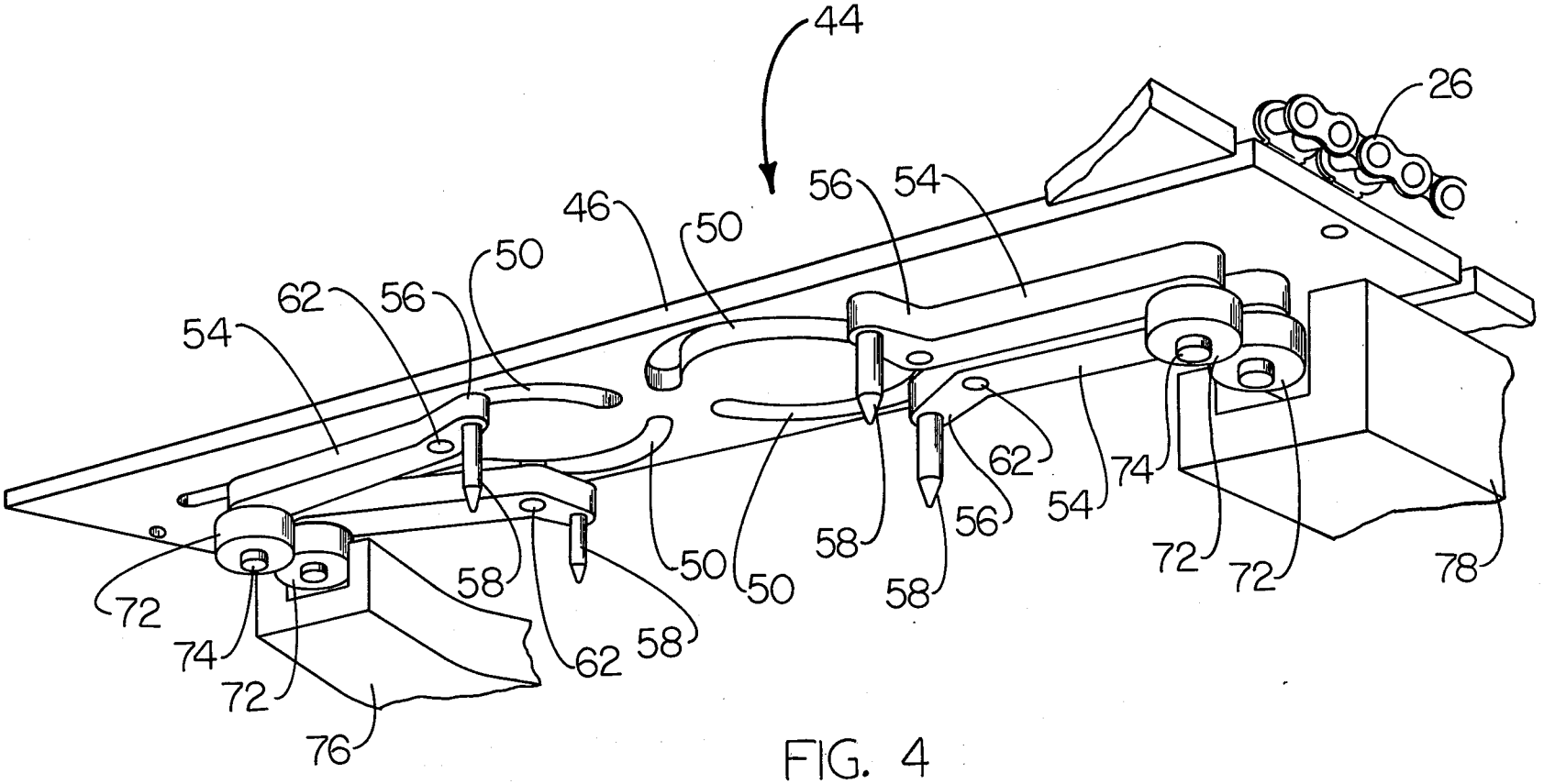
FIG. 4 is a bottom perspective view of a carrier applicating mechanism used in the assembly apparatus of the present invention.

The configuration of each pin element 52 is shown in FIG. 4 as having an arm portion 54 with an outwardly extending finger portion 56 that is, in turn, provided with a pin portion 58 extending outwardly from the carrier plate element 46. Each pin portion 58 is designed to enter an opening of a plastic carrier device 18 for stretching and application to containers 16, as will be described.

The manner in which each pin element 52 is slidably mounted to the carrier plate element 46 is best seen in FIGS. 3–4. Extending in a direction away from the pin portion 58 in the area of juncture of each arm portion 54 with each finger portion 56 is a bearing 60 rotatably mounted on shaft 62. The bearing 60 is rotatably and slidably mounted within a curvilinear slot 50 of the carrier plate element 46. The free end of the shaft 62 is threaded so as to receive a nut 64 for attaching the outwardly extending finger portion 56 and associated pin portion 58 of each pin element 52 in spaced and parallel relationship to the carrier plate element 46 with the freely rotatable bearing 60 in slidable mounting relationship to a curvilinear slot 50 thereof.

Similarly, the other end of the arm portion 54 opposite to the pin portion 58 has a rotatable bearing 66 mounted on a shaft 68, which bearing 66 is rotatably and slidably mounted within one parallel slot 48 of a carrier plate element 46. The threaded free end of the shaft 68 also receives a nut 70 for attaching the other end of the arm portion 54 in spaced and parallel relationship to the carrier plate element 46 with the freely rotatable bearing 66 in slidable mounting relationship to one parallel slot 48 of the carrier plate element 46.

On the opposite end of the shaft 68 is a rotatably mounted cam follower 72 that is fastened thereto by nut 74. Each pin element 52 has a cam follower that is adapted to ride in continuous closed cam tracks 76, 78 that are mounted to the frame supports 42 outside of the carrier plate elements 46 as best seen in FIGS. 3–6. The shape of the cam tracks 76, 78 controls the movement of the cooperating pairs of pin elements 52 in the various positions that are necessary to assemble carriers 18 to containers 16.

Figure 5:
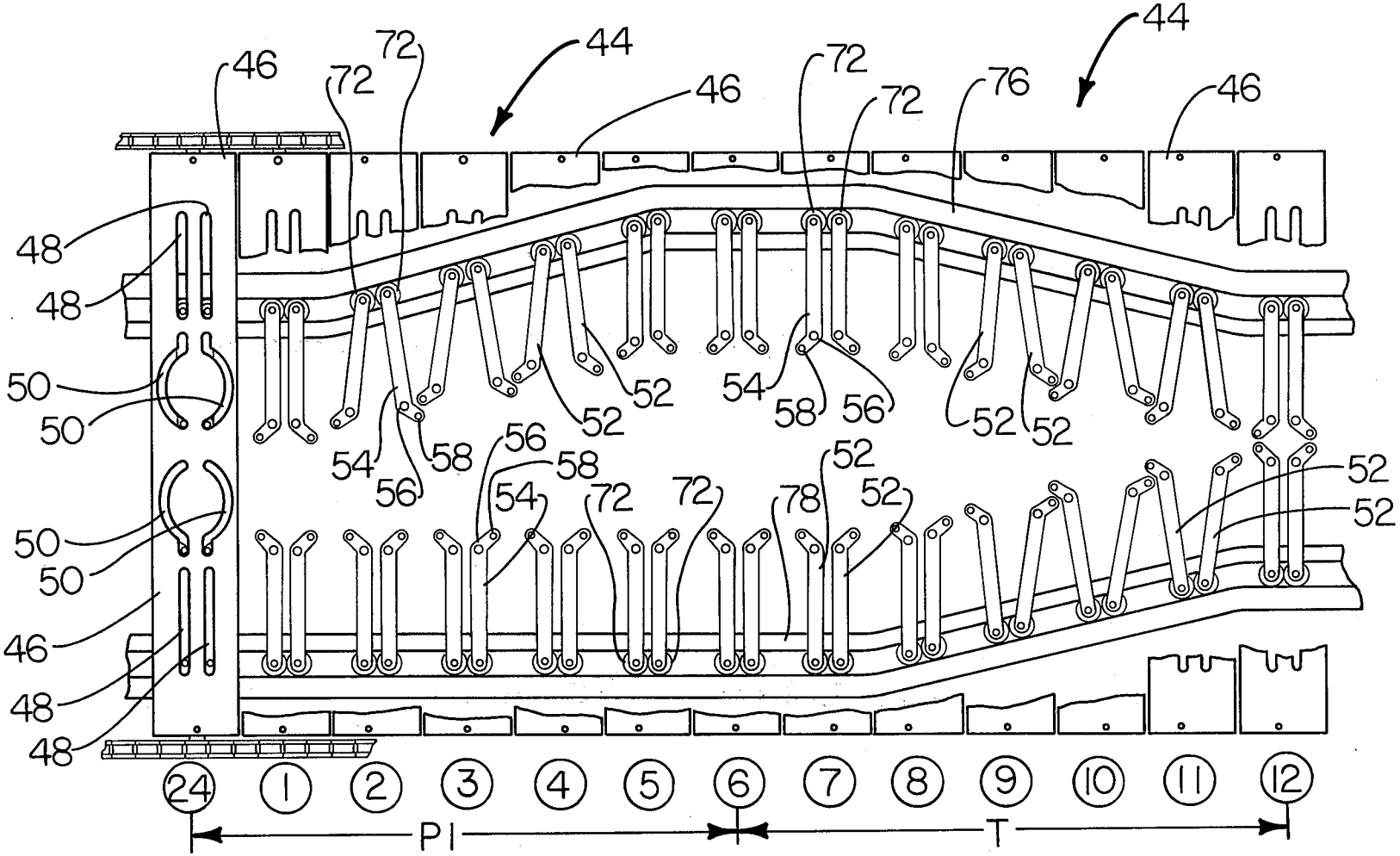
FIGS. 5 and 6 are fragmentary top plan views each showing one-half of the carrier assembly mechanisms extended across a horizontal plane to illustrate the various positions of the carrier assembly mechanisms at different locations thereof around the close path of the assembly apparatus.
Figure 6:
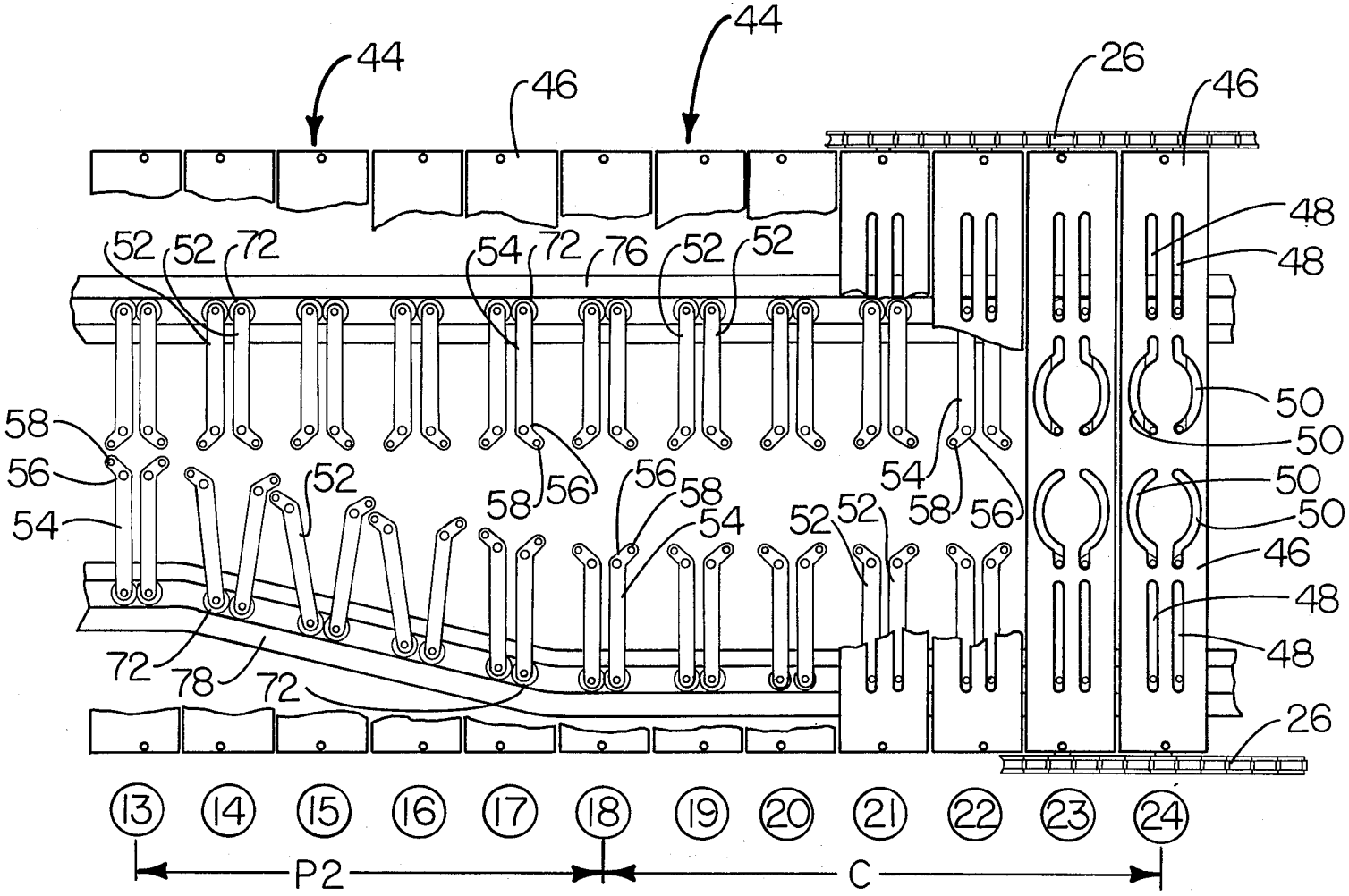

This is best shown in FIGS. 5–6 of the drawings of the drawings where there is illustrated fragmentary top plan views of carrier applicating mechanisms 44 extended across a horizontal plane to depict the various positions of the carrier assembly mechanisms 44, including cooperating pin elements 52 thereof, at different locations around the closed triangular path of the assembly apparatus 10. FIGS. 5 and 6 each show one-half of the carrier applicating mechanisms 44 as extended across a horizontal plane.

Since the assembly apparatus 10 is a bi-directional machine, carriers 18 may be assembled to containers 16 beginning generally transverse to the movement thereof on one or another side or container margin, depending on the direction of movement of said carrier assembly mechanisms 44 in the closed triangular path. As shown in the drawings, there are a plurality of containers arranged in two substantially parallel rows so that carriers 18 may be assembled to containers 16 beginning in the area between the two rows of containers 16 or along the outer margins of the two rows of containers, depending on the direction of movement of the carrier assembly mechanisms 44 in the closed triangular path.

There are 24 stations in the triangular path; stations 1–12 are shown in FIG. 5 while stations 13–24 are shown in FIG. 6. Pin element 52 positioning is represented by P1 and is shown from the midpoint of station 24 to the midpoint of station 5; carrier transfer to containers is represented by T and is shown from the midpoint of station 6 to the midpoint of station 12; pin element 52 positioning is represented by P2 and is shown from the midpoint of station 12 to the midpoint of station 10; and carrier placement on pin elements 52 is represented by C and is shown from the midpoint of station 18 to the midpoint of station 24.

Assuming that the assembly of apparatus 10 is operating in a clockwise fashion as shown in FIG. 1, then carriers would be placed on the pin elements 52 in the area C represented by stations 24–18 beginning at the right hand side of FIG. 6. Thus, the upper part of the left and right angular sides of the triangular path as shown in FIG. 1 includes stations 24–18 as shown in FIG. 6. The lower part of the right angular side of the triangular path as shown in FIG. 1 would contain stations 18–13 as shown in FIG. 6 and station 12 in FIG. 5 as represented by area P2 in FIG. 6 where the pin elements 52 are being positioned for subsequent carrier transfer with the carrier strip 12 mounted thereon. Carrier transfer would take place at area T between station 12–6 in FIG. 5 along the linear portion of the triangular path as shown in FIG. 1 which coincides with the linear path of the containers 16 at the upper end thereof. As can be seen in FIG. 5, carrier transfer begins (Station 12) with the pin elements 52 having pin portions 58 located in the area between the two rows of containers 16. The pin portions 58, with carrier strip 12 mounted thereon, then progressively assemble the carrier strip to the containers 16 and move to an area along the outer margins of the containers 16 (station 6). Thereafter, the pin elements 52 are extracted from the containers 16 with assembled carrier 18 in the lower part of the left angular side of the triangular path as shown in FIG. 1 as represented by the area P1 and stations 6–1 of FIG. 5.

Assuming that the assembly apparatus 10 is operating in a counter clockwise fashion, carriers would be placed on the pin elements 52 in the area C represented by stations 18–24 in FIG. 6 (corresponding with the upper part of the right and left angular sides of the triangular path in FIG. 1); pin elements 52 would than be positioned for subsequent carrier transfer in the area P1 represented by stations 1–6 in FIG. 5 (corresponding with the lower part of the left angular side of the triangular path as shown in FIG. 1); carrier transfer would take place at area T between stations 6–12 in FIG. 5 (corresponding with the linear portion of the triangular path in FIG. 1 as moving from left to right); and pin elements 52 would than be extracted from the containers 16 with assembled carrier 18 at the area P2 represented by station 12 in FIG. 5 and stations 13–18 in FIG. 6 (corresponding with the lower part of the right angular side of the triangular path in (FIG. 1). In the counter-clockwise direction, carriers 18 are assembled to container 12 beginning at the outer margins of the containers in station 6 and moving to an area between the containers as shown in station 12.

It will be noted that regardless of direction, the cooperating pairs of pin elements 52 move relative to each other at certain stations, and also diverge or converge relative to cooperating pairs of pin elements on the other side of the carrier plate means 46 at certain stations also. In the area represented by C in FIG. 6, the cam tracks 76, 78 maintain the cam followers 72 of each pin element in the same position to facilitate placement of the carrier strip 12 on the pin elements 52. In the area represented by P2 in FIG. 6, cam track 76 remains constant as in area C while cam track 78 forces the cam followers 72 and associated pin elements 52 in the various positions shown. Referring to area T in FIG. 5, it will be seen that the cam track 76, 78 cause converging or diverging of the pin elements 52, depending on the direction of movement of the carrier applicating mechanisms 44 in the triangular path. In the area represented by P1 in FIG. 5, cam track 78 maintains the pin elements 52 in a constant path on one side of the carrier plate means 46 while cam track 76 causes the pin elements 52 on the other side to move toward or away from the pin elements 52, depending on direction, which move in a constant path.

From the foregoing, it will be appreciated that the assembly apparatus 10 of the present invention is a highly efficient and versatile apparatus which can be used to apply different carriers utilizing different assembly techniques, if required. The structural arrangement of the various elements in the apparatus and their operation, while being entirely different than prior assembly apparatus, provides a simple, yet highly reliable machine that is also economical in construction and maintenance, and exceptionally durable with minimum part replacement.

What is claimed is:

1. A bi-directional assembly machine for assembling an interconnected series of plastic carrier devices to containers, comprising conveyor means for moving a plurality of containers in at least one row in a predetermined linear path, and carrier assembly means arranged to move in a predetermined closed path coinciding with said linear path along a portion thereof, said carrier assembly means being capable of bi-directional assembly of the interconnected series of carriers to containers and including means for assembling the interconnected series of carriers to said moving row of containers beginning generally transverse to the movement of said containers along a first container margin with assembly movement toward a second container margin when said carrier assembly means is operated in one direction in said closed path, said means for assembling the interconnected series of carriers to containers also being capable of moving generally transverse to the movement of said containers first along said second container margin with assembly movement toward said first container margin when said assembly means is operated in a second direction in said closed path.

2. The assembly machine as defined in claim 1 including a plurality of containers arranged to move in two substantially parallel rows in said predetermined linear path, said carrier assembly means including means for assembling the interconnected series of carriers to containers beginning in the inner marginal area between said two rows of containers when said carrier assembly means is operated in one direction and beginning along the outer margins of said two rows of containers when said carrier assembly means is operated in a second direction.

3. The assembly machine as defined in claim 2 wherein said carrier assembly means includes means for mounting said carrier assembly means for movement in a closed triangular path including a horizontal linear portion coinciding with the linear path of movement of said containers and upper angularly positioned triangular portions of said closed triangular path.

4. The assembly machine as defined in claim 3 wherein said carrier assembly means includes a plurality of pairs of pin elements positioned for assembly of carriers to each row of containers, each said pair of pin elements for each row being mounted for movement in diverging relationship to pairs of pin elements in an opposite row along the horizontal portion of the triangular path when the carrier assembly means is operated in one direction, each said pair of pin elements also being mounted for movement in converging relationship to pairs of pin elements in an opposite row along the horizontal portion of the triangular path when the carrier assembly means is operated in an opposite direction.

5. The assembly machine as defined in claim 4 wherein each said pair of pin elements for each row is mounted for the aforesaid diverging and converging along the sides of the triangular path prior to the aforesaid diverging and converging assembly movement in the horizontal portion of the triangular path, in order to position each pair of pin elements in proper relative position to the interconnected series of carriers.

6. The assembly machine as defined in claim 5 including means for causing only one row of said pairs of pin elements to operate in the aforesaid diverging and converging movements relative to said other row of pairs of pin elements in the upper angularly positioned triangular portions of the triangular path, prior to the aforesaid diverging and converging assembly movement in the horizontal portion of the triangular path.

7. An assembly machine for assembling an interconnected series of plastic carrier devices to containers, comprising conveyor means for moving a plurality of containers in two juxtaposed rows along a generally linear path, and carrier assembly means mounted for movement in a generally triangularly shaped path with rounded corner portions and including upper angular side portions and a linear portion which coincides with the linearly moving path of juxtaposed rows of containers at one end thereof, said carrier assembly means including a plurality of opposing pairs of pin elements which are mounted for movement in general alignment with said juxtaposed rows of containers along the linear portion of said triangular path, said carrier assembly means including means to position and feed the interconnected series of carriers relative thereto beginning in the vicinity of the rounded corner portion between the upper angular side portions and then along one upper angular side portion of the triangular path prior to progressively assembling said carriers to containers in the linear portion of said triangular path.

8. The assembly machine as defined in claim 7 including means for progressively assembling said carriers to containers by selective diverging movement of said opposing pairs of pin elements in the linear portion of said triangular path when said carrier assembly means are operated in one direction, said means for progressively assembling carriers to containers also moving said opposing pairs of pin elements in selective converging movement when said carrier assembly means is operated in an opposing direction.

9. The assembly machine as defined in claim 8 wherein said opposing pairs of pin elements are constrained to move in the aforesaid selective diverging and converging movement in said triangular path by chain driven carrier plate elements having means formed therein in which opposite ends of said pin elements are mounted, and cam track means in which only one end of said pin elements are mounted.

10. The assembly machine as defined in claim 9 wherein each pair of pin elements is mounted at one thereof in generally parallel means formed in said carrier plate means that extend generally transverse to the triangular path of movement, and the other end of said pin elements is positioned in generally curvilinear means formed in said carrier plate means that generally corresponds to the configuration of said containers.

11. The assembly machine as defined in claim 10 wherein said cam track means is positioned in overlying relationship to said generally parallel means formed in said carrier plate means, and said one end of said pin elements which is mounted relative to said cam track means includes cam follower elements arranged to move in said cam track means.

* * * * *